United States Patent [19]

Miyamoto et al.

[11] 4,375,632

[45] Mar. 1, 1983

[54] IGNITION CABLES

[75] Inventors: Yoshimi Miyamoto, Kariya; Keiichi Kojima; Yasuo Toriumi, both of Osaka, all of Japan

[73] Assignees: Sumitomo Electric Industries, Ltd., Osaka; Nippondenso Co., Ltd., Aichi, both of Japan

[21] Appl. No.: 230,932

[22] Filed: Feb. 2, 1981

[30] Foreign Application Priority Data

Jan. 31, 1980 [JP] Japan ..... 55-10873

[51] Int. Cl.[3] ..... H01C 3/06

[52] U.S. Cl. ..... 338/214; 338/66

[58] Field of Search ..... 338/66, 214; 174/120 SC, 113 R, 102 SC, 105 SC, 106 SC, 104; 252/510, 59; 156/50, 51, 52; 427/118; 428/373, 36

[56] References Cited

U.S. PATENT DOCUMENTS

| | | | |
|---|---|---|---|
| 3,787,255 | 1/1974 | Carini et al. | 174/120 SC X |
| 3,792,192 | 2/1974 | Plate | 174/120 SC X |
| 3,843,830 | 10/1974 | Priaroggia et al. | 174/120 SC X |

*Primary Examiner*—C. L. Albritton

*Attorney, Agent, or Firm*—Sughrue, Mion, Zinn, Macpeak and Seas

[57] ABSTRACT

A high voltage ignition cable is described comprising a resistive-conductor core, an insulator layer, and a jacket, wherein the resistive-conductor core comprises a tension member, a semiconductive internal layer, a semiconductive external layer, and a stripping layer interposed between the semiconductive internal layer and the semiconductive external layer.

6 Claims, 2 Drawing Figures

IGNITION CABLES

BACKGROUND OF THE INVENTION

This invention relates to improvements in a high voltage-ignition cable (hereinafter referred to as an "ignition cable") which is used to suppress radio interference generated by electrical ignition is an internal combustion engine, e.g., in a car, etc.

When conductive substances such as salts (e.g., for the prevention of freezing of roads in a cold district), sludge, etc., attach onto the external surface of a jacket of the ignition cable and the impedance thereof relative to the ground potential is lowered, the charging current flows out thereto according to the electrostatic capacity between a resistive-conductor core (hereinafter referred to as a "core", for simplicity) and the external surface of the jacket.

Therefore, as the electrostatic capacity increases, a reduction in the ignition voltage increases, resulting in poor ignition. In order to eliminate such poor ignition, it is necessary to use an ignition cable having as low an electrostatic capacity as 80 pF/m or less.

One way of lowering the electrostatic capacity is to increase the outer diameter of the ignition cable. However, increasing the outer diameter is not desirable, since the outer diameter of the ignition cable is usually about 7 or 8 mm, in that the ignition cable obtained can not be exchanged with conventional ones, and requires additional space.

In order to lower the electrostatic capacity while holding the outer diameter at a constant level, it is necessary to reduce the outer diameter of the core, and in order to lower the electrostatic capacity to the above-described level of 80 pF/m or less, it is necessary to reduce the outer diameter of the core to 1.2 mm or less.

By merely reducing the outer diameter of the core, however, the core will be cut off during the course of extrusion or vulcanization of the insulator, jacket, or the like, and thus it is not possible to produce, on a commercial scale, ignition cables which are sufficiently stabilized in high voltage withstanding ability, as in the case where glass fiber bundles are used as a tension member. The use of aromatic polyamide fiber bundles instead of the glass fiber bundle avoids the above-described defects but does not give a sufficient high voltage withstanding ability as described hereinafter. Furthermore, stabilized ability of the high voltage withstanding and problems such as difficulty in working of termination of the cable, etc., arise.

SUMMARY OF THE INVENTION

The first object of this invention is to obtain an ignition cable having a low electrostatic capacity as described hereinbefore, and at the same time to overcome the problems arising in reducing the outer diameter of the core in using a glass fiber bundle, and in using an aromatic polyamide fiber bundle.

The second object of this invention is to overcome the above-described defects by bringing the core into sufficiently close contact with the insulative material so as to overcome the poor high voltage withstanding ability, employing a core having a multilayer construction to facilitate termination, bringing the semi-conductive external layer of the core into close contact with the insulative material, and providing a conductive stripping layer between the semiconductive internal layer and the semiconductive external layer.

The third object of this invention is to provide an ignition cable in which the insulator and the semi-conductive external layer can be stripped off together with a stripping layer, termination can be conducted with ease since the layers lying beneath the stripping layer have a sufficient conductivity and therefore conduction between the ignition cable and the terminal prepared is much improved.

Therefore in accordance with the present invention a high voltage ignition cable is provided comprising a resistive-conductor core, an insulator layer, and a jacket, wherein the resistive-conductor core comprises a tension member, a semiconductive internal layer, a semi-conductive external layer, and a stripping layer interposed between the semiconductive internal layer and the semiconductive external layer.

DETAILED DESCRIPTION OF THE INVENTION

In order to suppress radio interference caused by ignition discharge, it is necessary to provide a resistance of about 16 KΩ/m in the core of the ignition cable. In general, therefore, a core having a diameter of about 1.8 mm, which is prepared by impregnating a glass fiber bundle with a carbon paint (i.e., a mixture of carbon black and a fluid binder which are dispersed in a solvent), has been employed. When the diameter of the glass fiber bundle used as the tension member is reduced, the core may be cut during the course of extrusion or vulcanization of the insulator layer, jacket, or the like. This makes the commercial production of such an ignition cable difficult.

Figure 1:
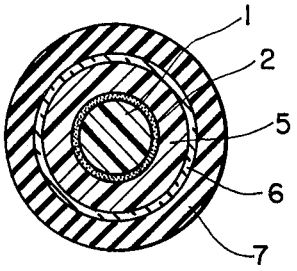
FIG. 1 is a traverse sectional view of a prior art ignition cable of low electrostatic capacity.

The above defect encountered in the use of the glass fiber bundle can be overcome by using an aromatic polyamide fiber of high strength. For example, as illustrated in FIG. 1, by impregnating a 1,500 denier aromatic polyamide (e.g., Kevler, a trademark for a product by E. I. Du Pont de Nemours Co.) fiber bundle 1 with a carbon paint 2 to provide a core having an outer diameter of from 0.9 to 1.2 mm, and providing on the core thus-obtained a cross-linked polyethylene insulator 5, a glass braid 6, and an ethylene-propylene rubber (EP rubber) or silicone rubber jacket 7, in that sequence, an ignition cable having a low electrostatic capacity of about 80 pF/m can be obtained.

However, the thus-obtained ignition cable of a low electrostatic capacity suffers from the disadvantage that its high voltage withstanding ability is unstable, and it is insufficiently durable for long and repeated use. That is, if an ignition coil voltage withstanding test is conducted which is a test wherein an ignition cable coated with a silver paint on the surface thereof and grounded is used, and an ignition coil voltage of 30 KV is applied on the core and discharged in a needle gap provided between the conductor of the cable and the ground, and judgement is made as to whether or not breakage of the ignition cable occurs within a period of time (e.g., 20,000 hrs) predetermined supposing that a car is driven a predetermined distance in simulation to situation which would occur most probably in practice, such an ignition cable is poor in high voltage withstanding ability.

As a result of extensive studies on the causes of poor high voltage withstanding ability, it has now been found that irregularity or unevenness of the surface of the core and the clearance between the core and the insulator are largely responsible for the poor high voltage withstanding ability.

In order to overcome the first cause, i.e., irregularity or unevenness of the surface of the core, it is necessary to make the surface smooth or even, for example, by extrusion-coating the core with semiconductive rubber or plastic, or by providing a sufficient coating of a highly viscous paint.

To overcome the other cause, i.e., the clearance between the core and the insulator, the core should be brought into close contact with the insulative material to be coated on the external surface thereof.

In an ignition cable in which the core and the insulative material are brought into close contact, when the insulator is stripped off in termination, the semiconductive layer is also stripped off together with the insulator. This results in poor conduction between the ignition cable and the terminal.

Therefore, a stripping layer has heretofore been provided on an external layer of a resistive-conductor core for the purpose of facilitating the stripping of the semiconductive layer from the insulative layer. The provision of the stripping layer on the outermost layer of the core as in the prior art methods results in ready formation of clearance between the semiconductive layer and the insulative layer. This clearance is liable to produce poor high voltage withstanding ability.

In order to provide good high voltage withstanding ability and facilitate terminal processing, according to this invention, a stripping layer is provided as an intermediate between a semiconductive internal layer and a semiconductive external layer.

For the formation of the stripping layer, a silicone paint prepared by mixing a conductive substance, e.g., carbon, graphite, silver, copper powder, with rubber or plastic as has heretofore been used for such purposes to prepare a semiconductive paint, and by mixing the semiconductive paint with silicone compound, can be used.

Figure 2:
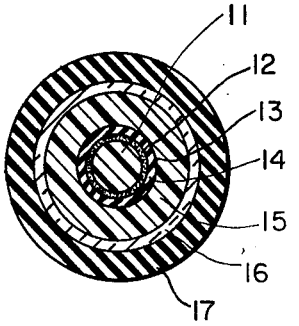
FIG. 2 is a traverse sectional view of an ignition cable of low electrostatic capacity according to this invention.

Hereinafter this invention will be explained in greater detail by reference to an example thereof, as illustrated in FIG. 2. This invention, however, is not limited thereto. In FIG. 2, numeral 11 shows a tension member, numeral 12 is a semiconductive, numeral 13 is a stripping layer, numeral 14 is a semiconductive external layer, numeral 15 is an insulator layer, numeral 16 is a reinforcing layer, and numeral 17 is a jacket.

Referring to FIG. 2, an aromatic polyamide fiber bundle 11 (1,500 denier) was impregnated with a carbon paint 12 to prepare a bundle having an outer diameter of 0.6 mm. A semiconductive ethylene-propylene rubber layer 14 was extruded on the aromatic polyamide fiber bundle obtained above through a stripping layer 13 of a silicone paint to prepare a resistive-conductor core having an outer diameter of 1.1 mm. On this resistive-conductor core were further provided an insulative layer 15 of cross-linked polyethylene, a glass braid 16 and an ethylene-propylene rubber jacket 17 in order to prepare an ignition cable.

The thus-obtained ignition cable had an electrostatic capacity of 79 pF/m. The ignition coil voltage withstanding test showed that all samples were satisfactory.

In performing termination, the insulative layer and the semiconductive external layer of the core could be separated from each other by means of the stripping layer, and since the stripping layer also had sufficient conductivity, termination could be performed with ease.

Ignition cables prepared in the same manner as described above, except that the insulator layer 15 was made from a blend of polyethylene and an ethylene-propylene rubber, or a cross-linked product of a blend of polyethylene and an ethylene-$\alpha$-olefin copolymer were prepared, and found to be low in electrostatic capacity, excellent in high voltage withstanding characteristics, and amenable to termination, as was the case with the cable in which polyethylene alone was used.

Also, ignition cables were prepared in the same manner as described above except that the semiconductive external layer was made from an ethylene/vinyl acetate copolymer-based semiconductive compound, and were found to be low in electrostatic capacity, excellent in high voltage withstanding characteristics, and amenable to termination.

As described above in detail, the product of this invention is excellent as an ignition cable.

Although the above explanation describes embodiments in which the reinforcing layer is provided below the jacket layer, it is also possible in this invention to separate the jacket into an internal protective layer and an external protective layer, and to provide the reinforcing layer between the internal layer and the external layer. The reinforcing layer may be a perforated tape or the like as well as the glass braid, and alternatively it may be omitted if desired.

While the invention has been described in detail and with reference to specific embodiments thereof, it will be apparent to one skilled in the art that various changes and modifications can be made therein without departing from the spirit and scope thereof.

What is claimed is:

1. A high voltage ignition cable comprising in order an innermost resistive-conductor core, an insulator layer, and a jacket, wherein the resistive-conductor core comprises a tension member having thereon, in order, a semiconductive internal layer and a semiconductive external layer, wherein a conductive stripping layer is interposed between the semiconductive internal layer and the semiconductive external layer.

2. A high voltage ignition cable as in claim 1, wherein the outer diameter of the resistive-conductor core is 1.2 mm and the tension member is of a maximum of an aromatic polyamide fiber bundle.

3. A high voltage ignition cable as in claim 1, wherein the semiconductive external layer is formed by extrusion coating of a semiconductive rubber.

4. A high voltage ignition cable as in claim 1, wherein the insulator layer comprises cross-linked polyethylene.

5. A high voltage ignition cable as in claim 1, wherein the semiconductive external layer is formed by extrusion coating of a semiconductive plastic composition.

6. A high voltage ignition cable as in claim 1, wherein the insulator layer comprises a cross-linked polymer blend containing polyethylene.

* * * * *